US008931884B2

(12) United States Patent
Fukunaga et al.

(10) Patent No.: US 8,931,884 B2
(45) Date of Patent: Jan. 13, 2015

(54) PRINTING APPARATUS

(71) Applicant: Canon Kabushiki Kaisha, Tokyo (JP)

(72) Inventors: Etsushi Fukunaga, Kawasaki (JP); Kenji Shimamura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/866,549

(22) Filed: Apr. 19, 2013

(65) Prior Publication Data

US 2013/0286094 A1 Oct. 31, 2013

(30) Foreign Application Priority Data

Apr. 27, 2012 (JP) ..... 2012-103808

(51) Int. Cl.

| | |
|---|---|
| ***B41J 29/38*** | (2006.01) |
| ***B41J 25/308*** | (2006.01) |
| ***B41J 23/00*** | (2006.01) |
| ***B41J 11/00*** | (2006.01) |
| ***B41J 19/18*** | (2006.01) |

(52) U.S. Cl.

CPC ..... *B41J 11/008* (2013.01); *B41J 19/18* (2013.01)

USPC ..... 347/37; 347/8; 347/9

(58) Field of Classification Search

CPC ..... B41J 11/20

USPC ..... 347/8–9, 37

See application file for complete search history.

(56) References Cited

U.S. PATENT DOCUMENTS

| | | | | |
|---|---|---|---|---|
| 7,063,468 | B2 | 6/2006 | Youn et al. | |
| 8,342,621 | B2 | 1/2013 | Saiga et al. | |
| 2005/0253880 | A1* | 11/2005 | Nakamura et al. | 347/8 |
| 2006/0132515 | A1 | 6/2006 | Buonerba et al. | |
| 2009/0257803 | A1 | 10/2009 | Okuda et al. | |
| 2010/0020124 | A1 | 1/2010 | Okazaki et al. | |
| 2010/0134558 | A1 | 6/2010 | Shiota | |
| 2011/0181659 | A1 | 7/2011 | Fukunaga | |

FOREIGN PATENT DOCUMENTS

| | | | |
|---|---|---|---|
| CN | 1532062 | A | 9/2004 |
| CN | 101618632 | A | 1/2010 |
| CN | 101837687 | A | 9/2010 |
| JP | 2001-171194 | A | 6/2001 |
| JP | 2010-284944 | A | 12/2010 |

OTHER PUBLICATIONS

Office Action in Chinese Patent Application No. 201310152985.5, dated Sep. 4, 2014.

* cited by examiner

*Primary Examiner* — Jason Uhlenhake

(74) *Attorney, Agent, or Firm* — Fitzpatrick, Cella, Harper & Scinto

(57) ABSTRACT

A wide-format printing apparatus can suppress a posture variation of a carriage to improve landing accuracy of ink, and can reduce an HP (head to platen) distance to the minimum gap, thus achieving higher image quality and mass-production performance. The HP distance, the main rail and the sub rail are adjustable, and the curve amount of both rails is made to be in agreement with the curve amount of the platen. After that, the adjustment for minimizing the local deformation of both rails is performed.

11 Claims, 16 Drawing Sheets

PRINTING APPARATUS

BACKGROUND OF THE INVENTION

1. Field of the Invention

The present invention relates to a printing apparatus which ejects ink on a print medium to perform printing thereon.

2. Description of the Related Art

An inkjet printing apparatus disclosed in Japanese Patent Laid-Open No. 2001-171194 is conventionally provided with mechanisms which, for correcting flexure and manufacturing errors of a rail determining a posture of a carriage in the rolling direction on which print heads are mounted, can adjust the rail by constant intervals in a main scan direction.

However, in a wide-format inkjet printing apparatus for performing printing on a print medium of 60 inches or more, a housing thereof is elongated. Therefore in view of costs and mass-production performance of the printer, the flexure in the weight direction of a platen supporting the print medium just under the print head has to be allowed to some extent. Therefore in a case where, for suppressing a posture variation of the carriage, the printer disclosed in Japanese Patent Laid-Open No. 2001-171194 is configured in such a manner as to adjust the rail to form a straight line, a distance between the print head and the platen (hereinafter called also an HP distance) can not be reduced to the minimum narrowness, creating a problem on the realization of higher image quality.

SUMMARY OF THE INVENTION

Therefore an object of the present invention is to provide a wide-format inkjet printing apparatus which can suppress a posture variation of a carriage to improve landing-on accuracy of ink, and can reduce a distance between a print head and a platen to the minimum narrowness, thus realizing higher image quality and mass-production performance.

Therefore a printing apparatus according to the present invention comprises a carriage mounting a print head and moves to a main scan direction, a main rail for guiding the carriage in the main scan direction, a sub rail for regulating a posture of the carriage to the main rail in a rotary direction, a platen for supporting a print medium conveyed in direction which crosses in the main scanning direction, a plurality of rail support base adjusting mechanisms for adjusting positions of the main rail and the sub rail corresponding to flexure of the platen in the main scan direction, main rail adjusting mechanisms for adjusting the position of the main rail in the main scan direction at plural locations, and sub rail adjusting mechanisms for adjusting the position of the sub rail in the main scan direction at plural locations.

According to the present invention, the printing apparatus comprises the plurality of rail support base adjusting mechanisms for adjusting the positions of the main rail and the sub rail corresponding to the flexure of the platen in the main scan direction. Further the printing apparatus comprises the main rail adjusting mechanisms for adjusting the position of the main rail in the main scan direction at the plural locations, and the sub rail adjusting mechanisms for adjusting the position of the sub rail in the main scan direction at the plural locations. Thereby there can be realized the wide-format printing apparatus which can suppress the posture variation of the carriage to improve landing-on accuracy of ink, and can reduce the distance between the print head and the platen (HP distance) to the minimum narrowness, thus achieving higher image quality and mass-production performance.

Further features of the present invention will become apparent from the following description of exemplary embodiments (with reference to the attached drawings).

DESCRIPTION OF THE EMBODIMENTS

First Embodiment

Figure 1:
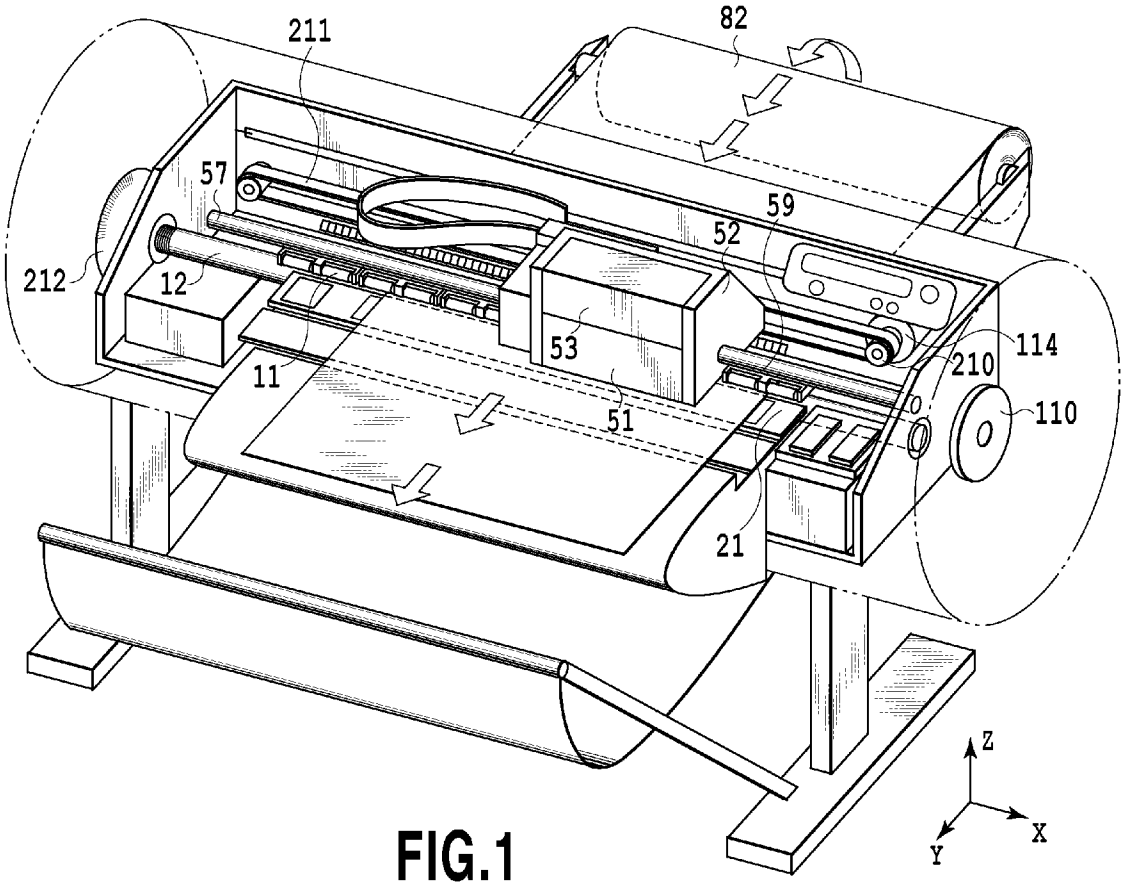
FIG. 1 is a schematic perspective view showing an inkjet printing apparatus to which the present invention is applicable.

Hereinafter, a first embodiment according to the present invention will be explained with reference to the accompanying drawings. FIG. 1 is a perspective view exemplifying a schematic configuration of an entire inkjet printing apparatus according to a first embodiment in the present invention. It should be noted that FIG. 1 absolutely schematically describes the entire printer, wherein a rail support base 61 and a sub rail 58, which will be described later, and the like are omitted in illustration.

The inkjet printing apparatus is provided with a carriage 52 reciprocating in an arrow X direction in FIG. 1. The carriage 52 is provided with a head holder 53, and print heads 51 (print components) capable of ejecting inks are removably installed in the head holder 53. The ink is supplied via an ink supply tube (not shown) to the print head 51 from an ink tank unit (not shown). The inkjet printing apparatus is also provided with a carriage motor 114 and a print medium conveying motor 110.

The carriage motor 114 is a motor for reciprocating the print head 51 in a main scan direction X, which causes the carriage 52, on which the print head 51 is mounted, to move (be slidable) along the main scan direction X to the right and left sides. A pulley 210 is provided in a rotary shaft of the carriage motor 114, and a timing belt 211 is wound around the pulley 210 to be in a tension state. The carriage 52 is connected to the timing belt 211. Therefore as the carriage motor 114 rotates in the forward-backward direction, the carriage 52 is guided by a main rail 57 to move in parallel on a platen 21.

The print medium conveying motor 110 is a motor for conveying a roll paper 82 as the print medium in a sub scan direction Y. The print medium conveying motor 110 drives and rotates a pinch roller 11 as a follower roller and a conveying roller 12 as a roller pair. An encoder film 212 is provided to be integral with the conveying roller 12, and a rotation amount of the conveying roller 12 is feedback-controlled by an encoder sensor (not shown) for reading slits in an entire circumference of the encoder film 212. The scan by the print head 51 following the movement of the carriage 52 reciprocating in the main scan direction and the movement of the conveying roller 12 pulling out the roll paper 82 by a predetermined amount respectively and conveying it in the sub scan direction are alternately performed with each other to achieve an image formation as a target.

Figure 2:
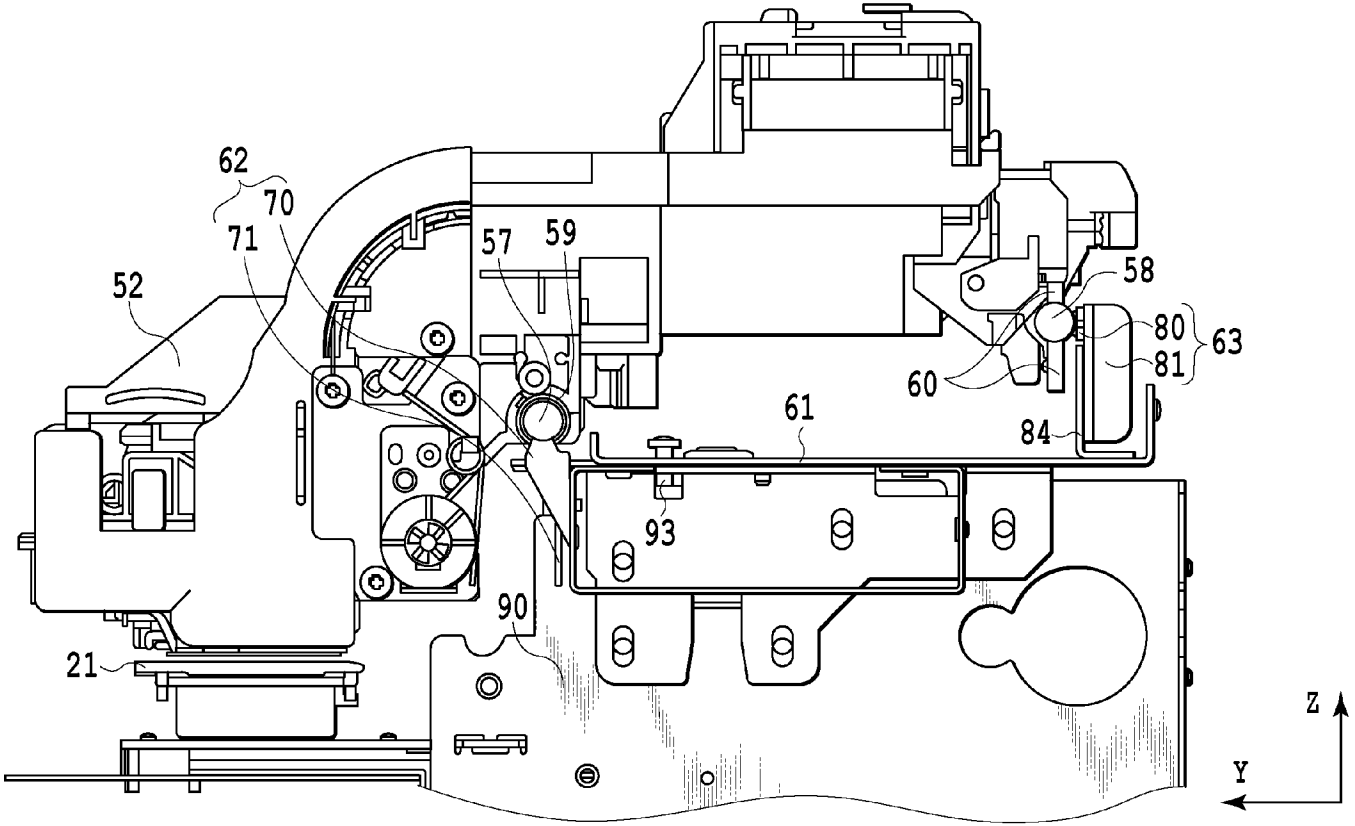
FIG. 2 is a schematic side view showing a rail configuration for supporting a carriage to which the present invention is applicable.

Next, the rail configuration for supporting the carriage 52 will be explained with reference to FIG. 2. FIG. 2 is a schematic side view showing an example of the rail configuration for supporting the carriage 52 in the inkjet printing apparatus in FIG. 1. The carriage 52 is supported by the main rail 57 extending in the main scan direction (arrow X direction in FIG. 1, and direction perpendicular to a paper surface in FIG. 2), and the sub rail 58 extending in the main scan direction determines the posture of the carriage 52 in a rolling direction (rotary direction) around the main rail 57. In addition, the carriage 52 slides through a bearing 59 to the main rail 57, and sandwiches the sub rail 58 by rotatable rollers 60 to reciprocate in the main scan direction.

The rail support base 61 on which the main rail 57 and the sub rail 58 are arranged is provided with a plurality of main rail adjusting mechanisms 62 capable of adjusting the main rail 57 in an arrow Z direction and a plurality of sub rail adjusting mechanisms 63 capable of adjusting the sub rail 58 in the arrow Z direction. In this way, the main rail 57 and the sub rail 58 can be adjusted in the arrow Z direction at the plural locations. In addition, the rail support base 61 is provided with a first rail support base adjusting mechanism 93, a second rail support base adjusting mechanism 94 (refer to FIG. 7C described later), a third rail support base adjusting mechanism 95 (refer to FIG. 7B described later), and a fourth rail support base adjusting mechanism 96 (refer to FIG. 7B described later), which are capable of adjusting the rail support base 61 in the arrow Z direction.

Figure 3:
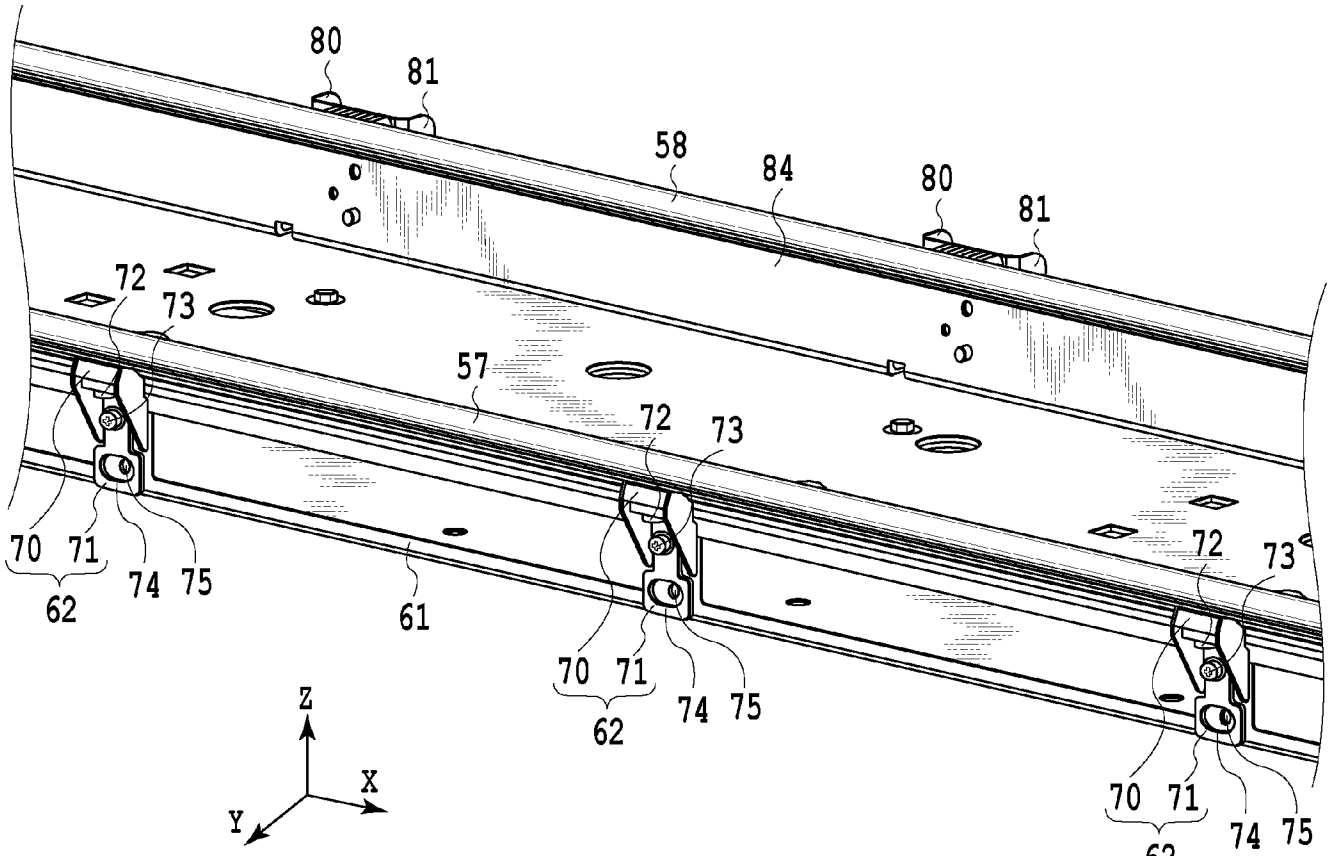
FIG. 3 is a schematic perspective view showing main rail adjusting mechanisms to which the present invention is applicable.
Figure 4:
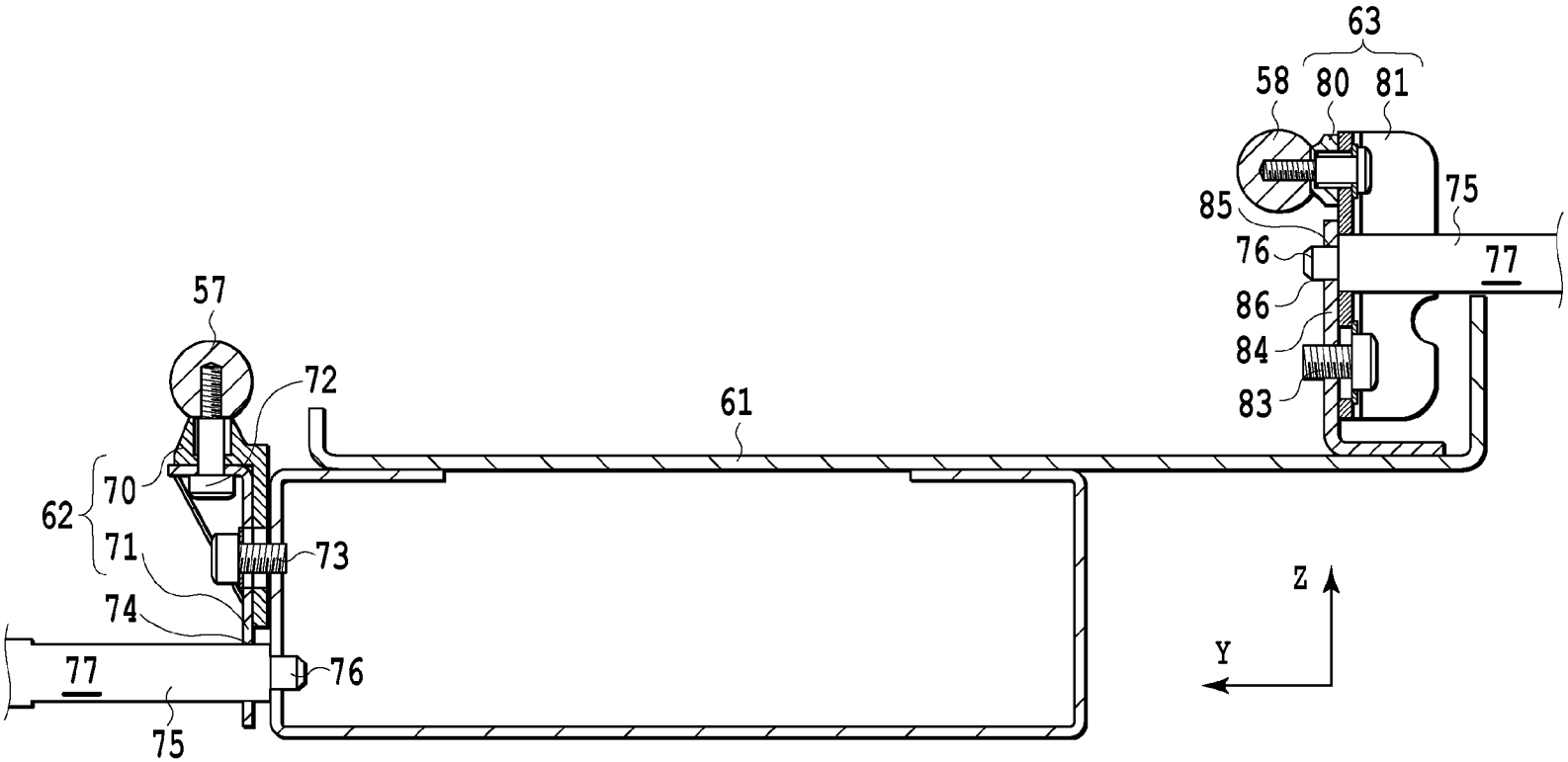
FIG. 4 is a schematic cross section showing a rail support base to which the present invention is applicable.
Figure 5:
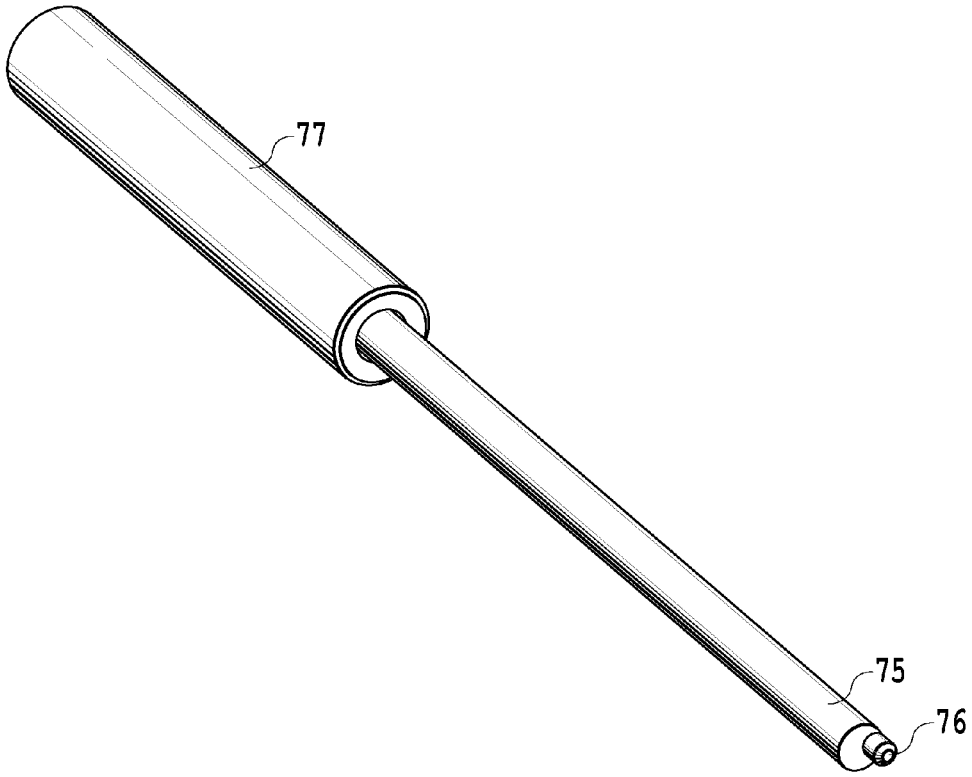
FIG. 5 is a perspective view showing a rail adjusting tool to which the present invention is applicable.

Hereinafter, a concrete configuration of each of the main rail adjusting mechanism 62, the sub rail adjusting mechanism 63, and the first to fourth rail support base adjusting mechanisms will be explained. First, the configuration of the main rail adjusting mechanism 62 will be explained with reference to FIG. 3 and FIG. 4. FIG. 3 is a schematic perspective view showing an example of the configuration of the main rail adjusting mechanism 62, and FIG. 4 is a schematic cross section of the rail support base 61. The main rail 57 is fastened and fixed via a main rail supporting member 70 made of a resin member to the rail support base 61 by a main rail adjusting member 71 and a bolt 72 at each of the plural locations in the main scan direction.

Each of the main rail adjusting members 71 is fastened to the rail support base 61 by a bolt 73, and on the other hand, is provided with the configuration capable of being adjusted in the arrow Z direction. Specifically an oval hole 74 is formed in the main rail adjusting member 71, and a circular hole 75 is formed in the rail support base 61. By inserting a tip end 76 of a tool 77 provided with an eccentric shaft 75 at its tip end into the circular hole 75 and rotating the tool 77 therein, a position of the main rail adjusting member 71 in the arrow Z direction is adjusted. Therefore the position of the main rail 57 in the arrow Z direction can be finely adjusted by one micron order.

Figure 6:
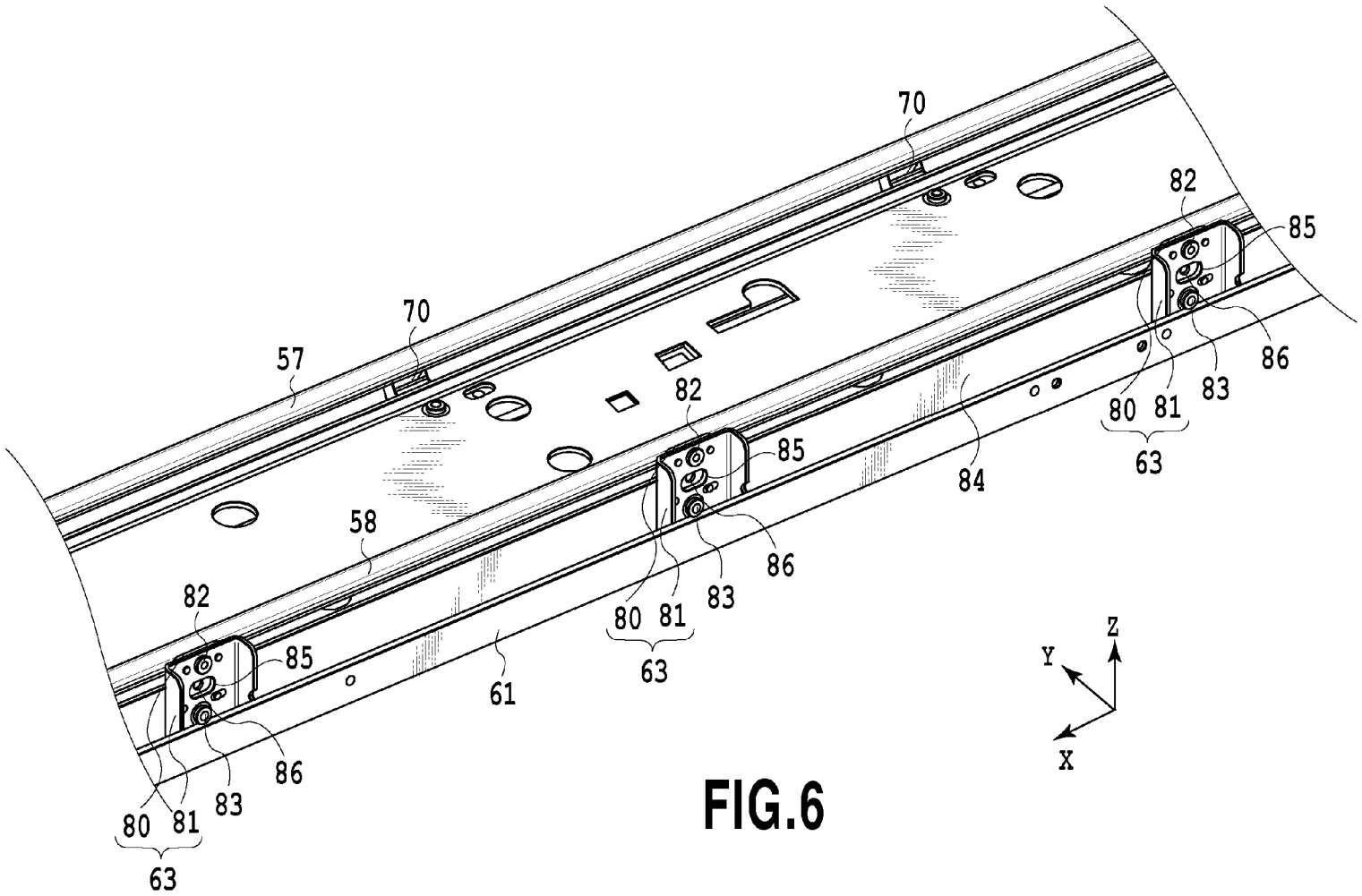
FIG. 6 is a schematic perspective view showing sub rail adjusting mechanisms to which the present invention is applicable.

Next, the configuration of the sub rail adjusting mechanism 63 will be explained with reference to FIG. 4 and FIG. 6. FIG. 6 is a schematic perspective view showing an example of the configuration of the sub rail adjusting mechanism 63 in the inkjet printing apparatus in FIG. 1. The sub rail 58 is fastened and fixed via a sub rail supporting member 80 made of a resin member to the rail support base 61 by a sub rail adjusting member 81 and a bolt 82 at each of plural locations in the main scan direction. Each of the sub rail adjusting members 82 is fastened by a bolt 83 to a sub rail support base 84 fixed to the rail support base 61, and, on the other hand, is provided with the configuration capable of being adjusted in the arrow Z direction. Specifically an oval hole 85 is formed in the sub rail adjusting member 81, and a circular hole 86 is formed in the sub rail support base 84. By inserting the tip end 76 of the aforementioned tool 77 into the circular hole 86 and rotating the tool 77 therein, a position of the sub rail adjusting member 81 is adjusted in the arrow Z direction. Therefore the sub rail 58 can be finely adjusted by one micron order in the arrow Z direction.

Figure 7A:
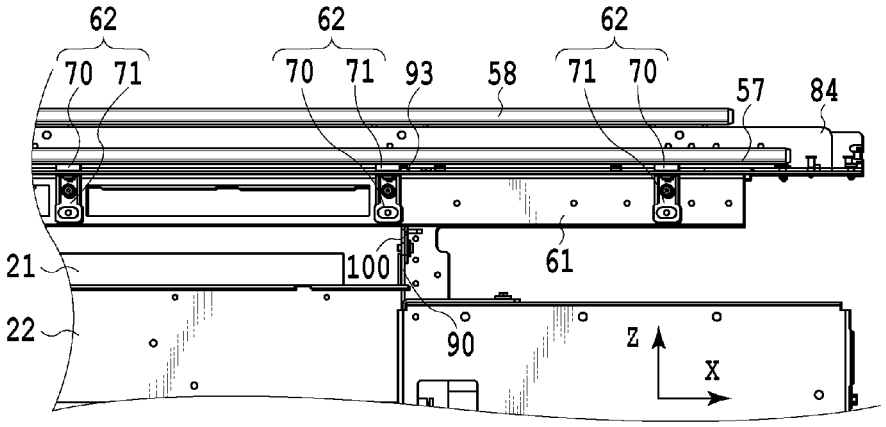
FIG. 7A is a schematic front view showing a housing configuration (body right side portion alone)
Figure 7B:
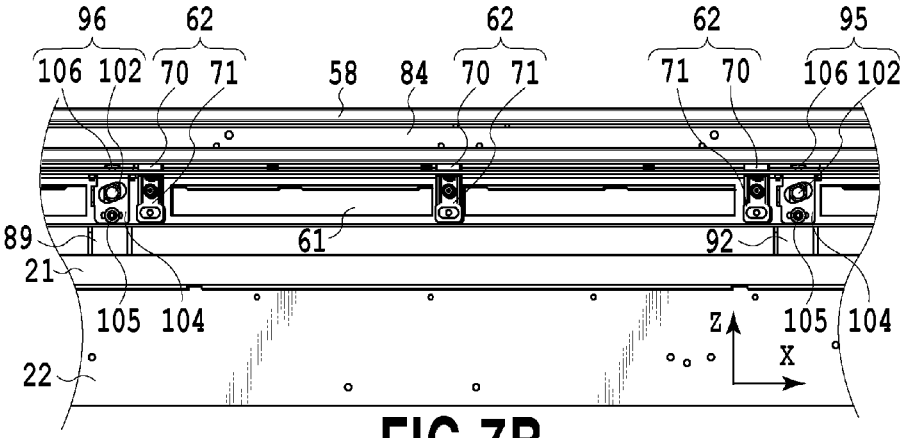
FIG. 7B is a schematic front view showing the housing configuration (body central portion alone)
Figure 7C:
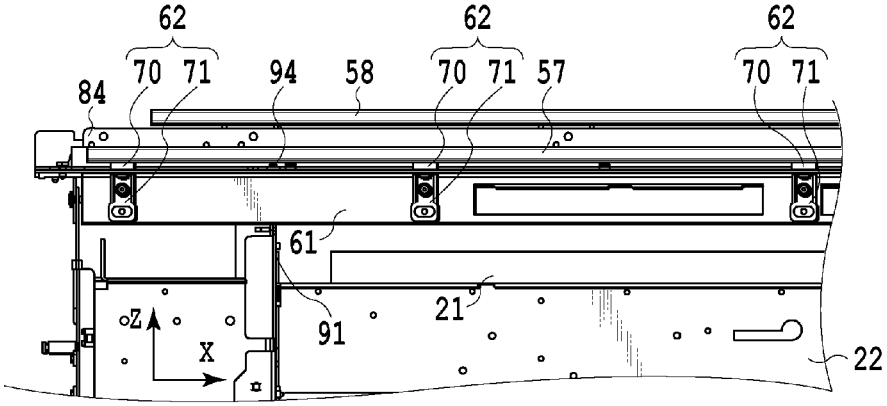
FIG. 7C is a schematic front view showing the housing configuration (body left side portion alone)

The arrangement of the first to fourth rail support base adjusting mechanisms will be explained with reference to FIG. 7A to FIG. 7C. FIG. 7A is a schematic housing configuration view showing the right portion of the front surface of the body, FIG. 7B is a schematic housing configuration view showing the central portion of the front surface of the body, and FIG. 7C is a schematic housing configuration view showing the left portion of the front surface of the body. The rail support base 61 is supported at both sides thereof by a right plate 90 arranged in the right side of the platen 21 in the arrow X direction and a left plate 91 likewise arranged in the left side of the platen 21 in the arrow X direction. In addition, a substantially central portion of the rail support base 61 is supported by the right center support member 92 and a left center support member 89 arranged in a substantially central portion of the platen 21 in the arrow X direction.

The first rail support base adjusting mechanism 93 adjusting the rightmost side of the platen 21 in the arrow X direction and the left side of the rail support base 61 in the arrow Z direction is provided in the right side of the rail support base 61. The second rail support base adjusting mechanism 94 adjusting the leftmost side of the platen 21 in the arrow X direction and the left side of the rail support base 61 in the arrow Z direction is provided in the left side of the rail support base 61. The third rail support base adjusting mechanism 95 and the fourth rail support base adjusting mechanism 96 adjusting the substantially central portion of the platen 21 in the arrow X direction and the substantially central portion of the rail support base 61 in the arrow Z direction are provided in the central portion of the rail support base 61.

Figure 8:
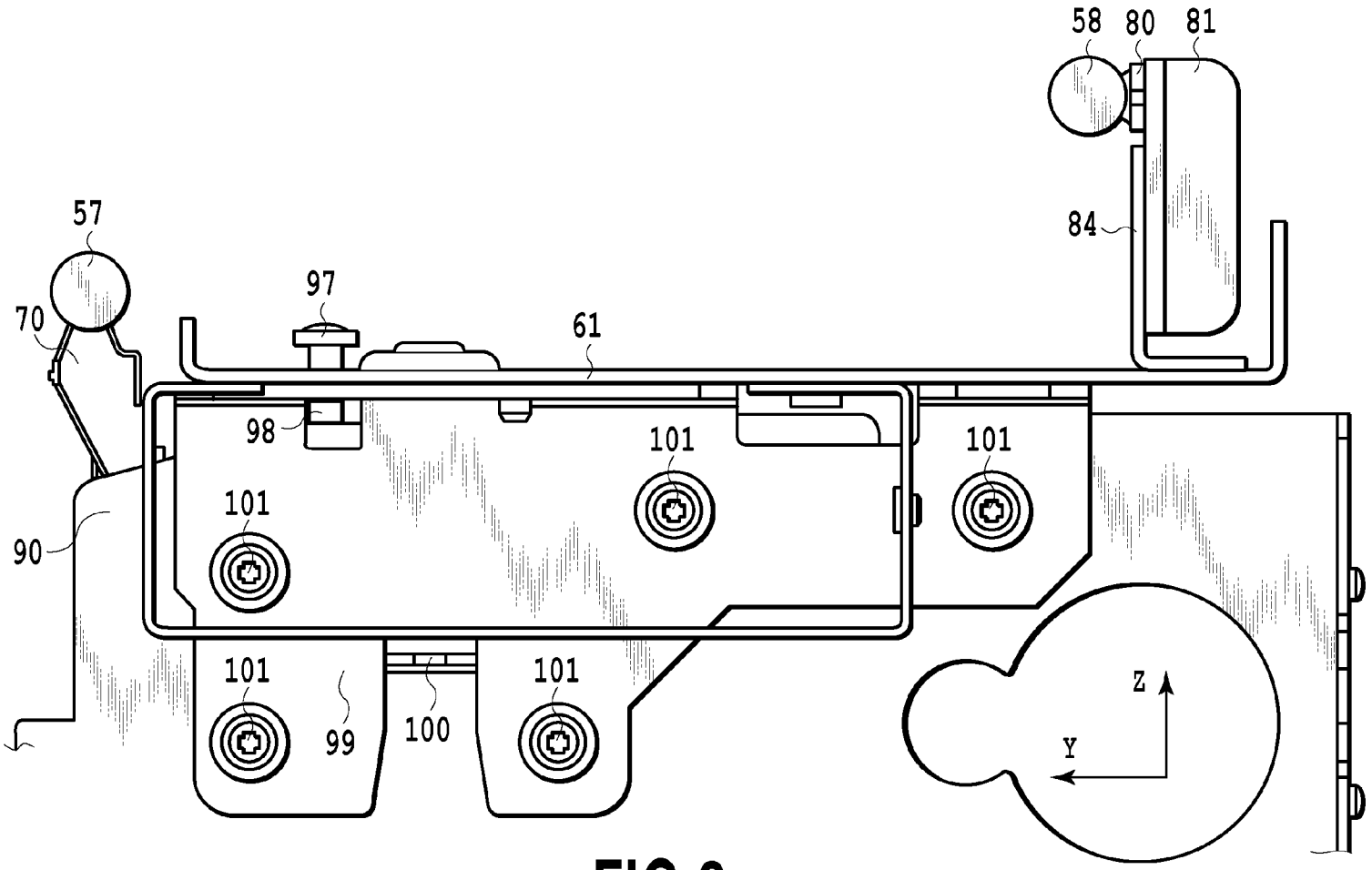
FIG. 8 is a schematic side view showing a first rail support base adjusting mechanism to which the present invention is applicable.

First, the configuration of the first rail support base adjusting mechanism 93 will be explained with reference to FIG. 7A and FIG. 8. FIG. 8 is a schematic side view showing an example of the configuration of the first rail support base adjusting mechanism 93. The rail support base 61 is provided with a Z-direction adjusting bolt 97 just under the rail support base 61 and the carriage 52 (refer to FIG. 1 and FIG. 2) in the center of gravity in the arrow Y direction, and a tip end of the Z-direction adjusting bolt 97 makes contact with an edge portion 98 of an upper portion in the right plate 90. In addition, a guide member 99 arranged in the rail support base 61 substantially fits in a raised portion 100 provided in the right plate 90. Therefore as the Z-direction adjusting bolt 97 is fastened in, the rail support base 61 is raised in the arrow Z direction on a basis of the right plate 90, thus making it possible to adjust the position of the rail support base 61 in the arrow Z direction.

In addition, without mentioning, when the Z-direction adjusting bolt 97 is rotated in the backward direction, the rail support base 61 moves in such a direction that a distance in the arrow Z direction between the rail support base 61 and the right plate 90 is shorter. In this way, the first rail support base adjusting mechanism 93 is configured such that a relative distance in the arrow Z direction of the rail support base 61 to the right plate 90 can be adjusted by using the Z-direction adjusting bolt 97. In addition, after adjusting the rail support base 61 in the arrow Z direction, the rail support base 61 is fastened and fixed to the right plate 90 by bolts 101 for positioning.

The second rail support base adjusting mechanism 94 described in FIG. 7C has the same basic configuration as that of the first rail support base adjusting mechanism 93. The second rail support base adjusting mechanism 94 is also configured such that a relative distance in the arrow Z direction of the rail support base 61 to the left plate 91 can be adjusted by using the Z-direction adjusting bolt 97.

Figure 9:
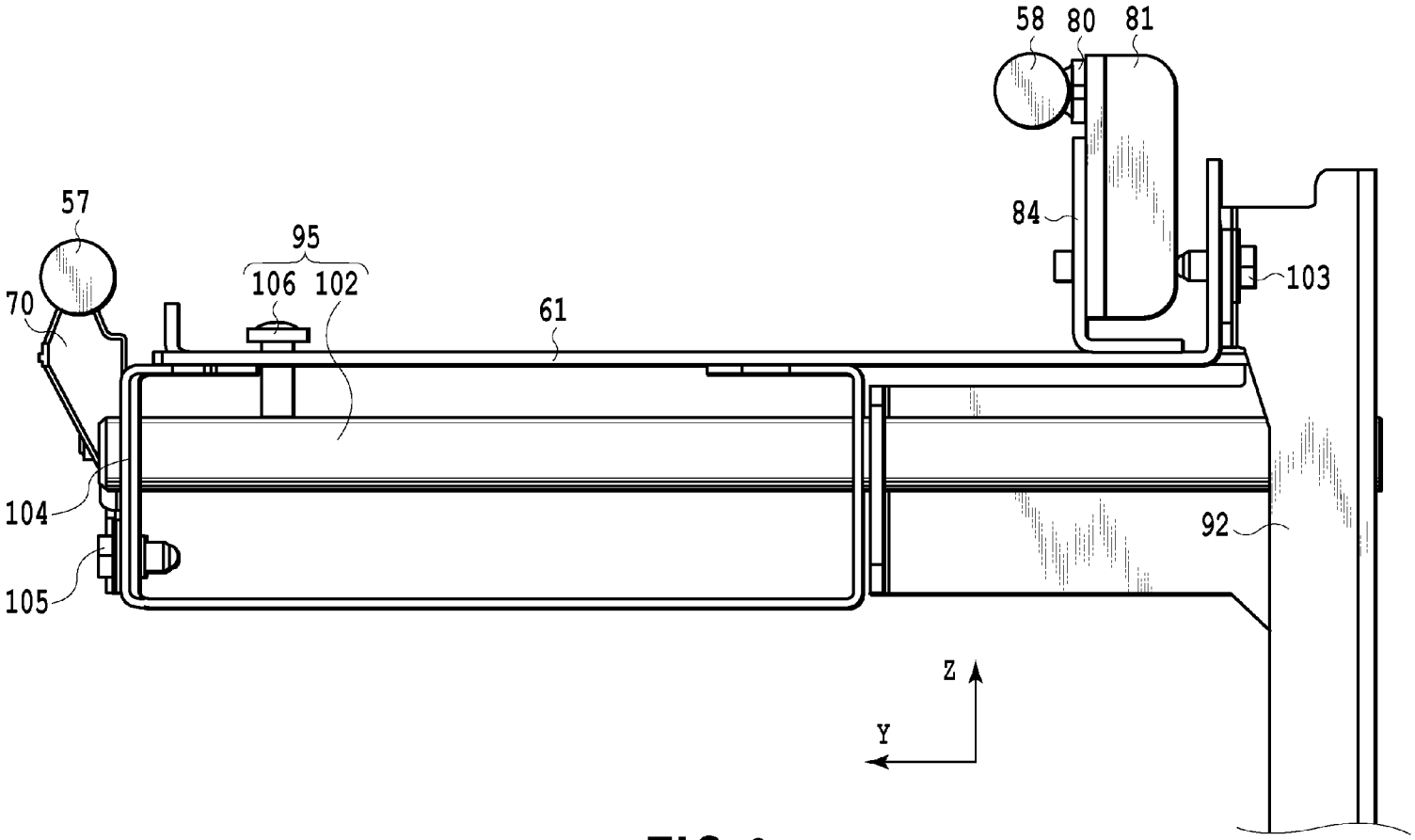
FIG. 9 is a schematic side view showing a third rail support base adjusting mechanism to which the present invention is applicable.

Next, the third rail support base adjusting mechanism 95 and the fourth rail support base adjusting mechanism 96 will be explained with reference to FIG. 7B and FIG. 9. FIG. 9 is a schematic side view showing an example of the configuration of the third rail support base adjusting mechanism 95. A substantially central portion of the rail support base 61 in the arrow X direction (direction perpendicular to a paper surface in FIG. 9) is provided with Z-direction adjusting bolts 106 at two locations in positions of both end portions of the carriage 52 in the arrow X direction at the time of moving the carriage 52 to a substantially central portion of the platen 21 in the arrow X direction.

In addition, as similar to the first and second rail support base adjusting mechanisms, the Z-direction adjusting bolt 106 is arranged just under the position of the center of gravity of the carriage 52 in the arrow Y direction and the rail support base 61. The Z-direction adjusting bolt 106 is configured in such a manner as to make contact with a shaft 102 provided in each of a right center support member 92 and a left center support member 89, and adjust a central portion of the rail support base 61 using the shaft 102 as a base. After adjusting the rail support base 61 in the arrow Z direction, a backside of the rail support base 61 is fastened and fixed to the right center support member 92 (left center support member 89) by a bolt 103. In addition, in a front surface side of the rail support base 61, in a state where a stationary member 104 is fitted in the shaft 102 to regulate a relative position relation between the rail support base 61 and the shaft 102, the stationary member 104 is fastened and fixed to the rail support base 61 by a bolt 105.

Next, an adjusting method of the rail using the configuration in the present invention will be explained. Factors important for an image quality improvement of the inkjet printing apparatus may include restriction of a posture variation on the carriage 52 and the minimum narrowness of a distance between the print head 51 and the print medium. When the posture variation of the carriage 52 occurs, ink landing-on positions in the arrow Y direction between nozzles of different colors arranged within the print head 51 to be separated from each other by the maximum of 100 mm deviate (hereinafter, called a Y-direction color deviation) to degrade the image quality. Therefore the rail adjustment for minimizing local deformation of the main rail 57 and the sub rail 58 becomes important.

As the distance between the print head 51 and the print medium is shifted from a predetermined distance, the landing-on deviation due to an air stream in the vicinity of the print head 51 is generated to degrade the image quality. Therefore the rail adjustment is required for keeping the distance between the print head 51 and the platen 21 (HP distance) to be constant across an entire area in the print region. Incidentally in the wide-format inkjet printing apparatus, the flexure of a platen housing 22 in the direction of the center of gravity (lower side in the arrow Z direction) for supporting the platen 21 is generated in the order of 0.5 mm by the flexure due to the own weight of the platen housing 22 and a nip pressure of the pinch roller 11 to the conveying roller 12. Therefore assuming that the main rail 57 and the sub rail 58 are respectively adjusted in such a manner as to form a straight line, a difference of the order of 0.5 mm is generated in the HP distance between both the end portions and the central portion in the print region in the arrow X direction, as a result creating a problem that the minimum narrowness of the HP distance can not be achieved.

Therefore according to the present invention, for achieving both of a reduction in the landing-on deviation caused by the posture variation of the aforementioned carriage 52 and a reduction in the landing-on deviation caused by the HP distance (air stream), a curve amount of each of both the rails is first made to be in agreement with a curve amount of the platen 21. After that, the rail adjustment for minimizing the local deformation of both the rails is performed.

Figure 10:
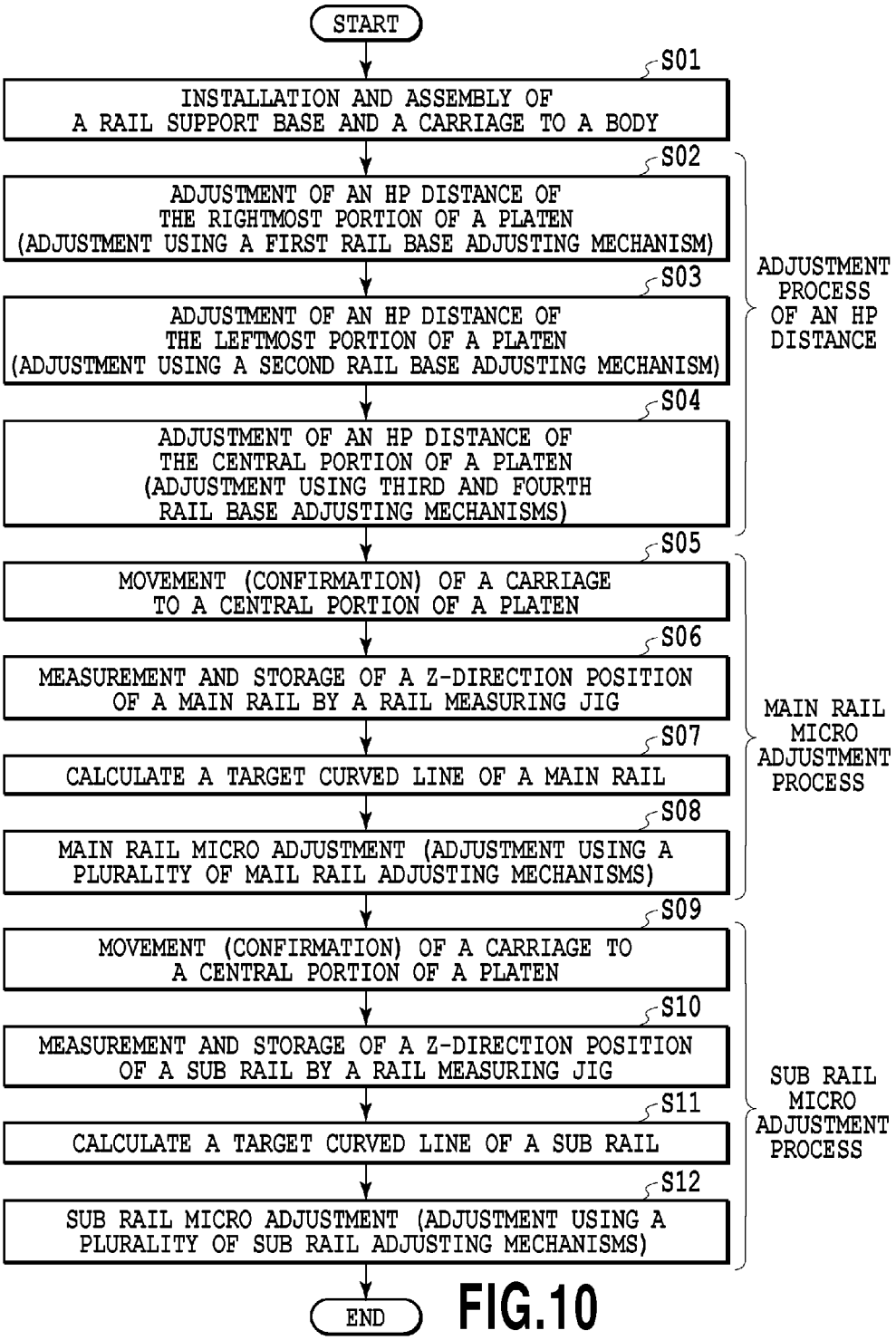
FIG. 10 is a flow chart showing an example of the rail adjusting procedure to which the present invention is applied.

Hereinafter, a concrete adjusting method of the rail in the present invention will be explained with reference to FIG. 2, FIG. 4, FIGS. 7A-7C and a flow chart in FIG. 10. First, as the rail adjustment is started, at step S01 the rail support base 61 is located to the right plate 90, the left plate 91, the right center support member 92 and the left center support member 89. Next, as shown in FIG. 2, the carriage 52 is assembled to the main rail 57 and the sub rail 58.

After that, the carriage 52 is moved to the rightmost upper portion of the platen 21 in the arrow X direction shown in FIG. 7A. A tool (HP jig) capable of measuring the HP distance is set to the head holder 53 in the carriage 52 in that state, and at step S02 an HP distance in the rightmost portion of the platen is adjusted using the first rail support base adjusting mechanism 93 shown in FIG. 7A by looking at a value of the HP jig. Next, the carriage 52 is moved to the leftmost upper portion of the platen 21 in the arrow X direction shown in FIG. 7C.

Similarly at step S03 an HP distance in the leftmost portion of the platen is adjusted using the second rail support base adjusting mechanism 94 shown in FIG. 7C by looking at a value of the HP jig. Next, the carriage 52 is moved to a substantially central part in the print region printable by the print head 51 in the arrow X direction on the platen 21 shown in FIG. 7B. In addition, similarly at step S04 an HP distance in the central portion of the platen is adjusted using the third rail support base adjusting mechanism 95 and the fourth rail support base adjusting mechanism 96 shown in FIG. 7B by looking at a value of the HP jig. The steps until this correspond to the process of adjusting the HP distance (the process until this is called an adjusting process of the HP distance).

Figure 11:
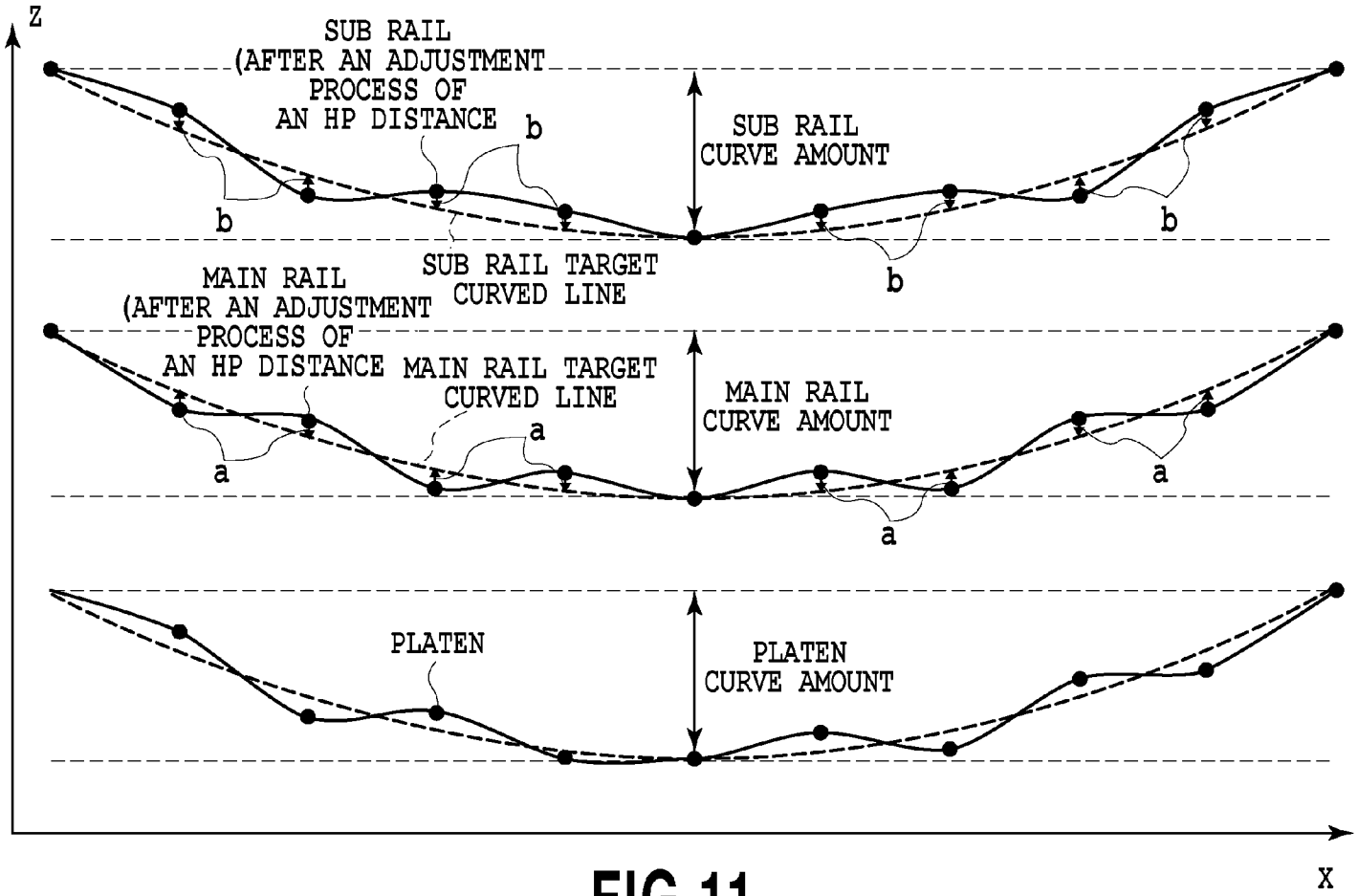
FIG. 11 is a schematic explanatory diagram showing rail states after the HP distance adjustment process to which the present invention is applied.

FIG. 11 is a schematic explanatory diagram showing rail states after the adjusting process of the HP distance is performed. In a state where the carriage 52 is positioned in the center upper portion of the platen 21 in the arrow X direction after completion of the adjusting process of the HP distance, a schematic position relation among the main rail 57, the sub rail 58, and the platen 21 is as shown in FIG. 11. That is, a curve amount of the main rail 57 and a curve amount of the sub rail 58 are substantially in agreement with a curve amount of the platen 21.

Next, for reducing the Y-direction color deviation, the rail adjustment for minimizing the local deformation of the main rail 57 and the sub rail 58 is performed. First, the main rail adjusting mechanisms 62 shown in FIG. 4 are used to perform the adjustment for minimizing the local deformation of the main rail 57. Specifically at step S05 the carriage 52 is made to be positioned in the substantially central portion of the platen 21 in the arrow X direction, and at step S06 a position of each of the main rail adjusting mechanisms 62 in the arrow Z direction of the main rail 57 is measured by a rail measuring jig for storing.

Further, at step S07 a target curved line is produced on a basis of each measured value and a position of each measured position in the arrow X direction by the method of least squares. After that, at step S08 micro adjustment of one micro order is performed on a basis of the target curved line in each adjustment position using the main rail adjusting mechanism 62 for a target value. The adjustment amount of the main rail 57 at this time corresponds to a part shown in a portion in FIG. 11. The steps until this indicate the process for adjusting the main rail 57 (this process is called a micro adjustment process of the main rail).

Next, the sub rail adjusting mechanisms 63 shown in FIG. 4 are used to perform the adjustment for minimizing the local deformation of the sub rail 58. Specifically at step S09 the carriage 52 is made to be positioned in the substantially central portion of the platen 21 in the arrow X direction, and at step S10 a position of each of the sub rail adjusting mechanisms 63 in the arrow Z direction of the sub rail 58 is measured by the rail measuring jig to store the measured position. In addition, at step S11 a target curved line is produced based upon each measured value and a position in the arrow X direction of each measured position by the method of least squares. After that, the sub rail adjusting mechanism 63 is used to perform the micro adjustment of one micron order on a basis of the target curved line in each adjustment position for this target value. The adjustment amount of the sub rail 58 at this time corresponds to a part shown in a b portion in FIG. 11. The steps until this indicate the process for adjusting the sub rail 58 (this process is called a micro adjustment process of the sub rail).

It should be noted that the curve amount of the target curved line of the sub rail 58 may be corrected for making the curve amount of the sub rail 58 be in agreement with the curve amount of the main rail 57 in the sub rail micro adjustment process. Specifically the target curved line of the sub rail 58 is calculated on a condition that the curved line of the sub rail 58 is in complete agreement with the curved line of the main rail 57. In this case, the adjustment man-hour is slightly increased, but it is possible to further reduce the Y-direction color deviation.

Through such a rail adjustment, each of the curve amount of the main rail 57 and the curve amount of the sub rail 58 is substantially in agreement with the curve amount of the platen 21, and the local deformation of each of the main rail 57 and the sub rail 58 can be minimized. As a result, both the landing-on deviation due to the posture variation factor of the carriage 52 and the landing-on deviation due to the HP factor (air stream factor) can be reduced to further improve the image quality. In addition, the adjustment process of the HP distance for adjusting the rail support base 61 itself to the platen 21 is provided before the rail micro adjustment process as in the present invention, and therefore the adjustment amount in the rail micro adjustment process is made small, making it possible to largely reduce the adjustment man-hour.

This result particularly remarkably occurs in the wide-format inkjet printing apparatus. Further, since it is possible to perform the adjustment of the HP distance including the component tolerance of the carriage 52, it is possible to adjust the HP distance with higher accuracy. Further, in the micro adjustment process of each of the main rail 57 and sub rail 58, the adjustment of the rail is performed in a state of positioning the carriage 52 in the central portion of the platen 21 in the arrow X direction. Thereby it is possible to perform the adjustment of the rail in consideration of the deformation of the rail support base 61 by the weight of the carriage 52 to further reduce the Y-direction color deviation.

As described above, an explanation is made of one embodiment in the present invention, but the present invention is not limited to this embodiment, and various kinds of embodiments may be adopted within the scope not departing from the subject matter without mentioning.

In this way, the HP distance, the main rail and the sub rail are respectively adjustable; the curve amount of each of both the rails is made to be substantially in agreement with the curve amount of the platen 21, and after that, the adjustment for minimizing the local deformation of each of both the rails is performed.

Thereby there can be realized the wide-format inkjet printing apparatus which can suppress the posture variation of the carriage to improve the landing-on accuracy of the ink, and can reduce the HP distance to the minimum narrowness, therefore achieving higher image quality and mass-production performance.

Second Embodiment

Hereinafter, an explanation will be made of a second embodiment in the present invention with reference to the drawings. It should be noted that since the basic configuration in the present embodiment is the same as that of the first embodiment, a characteristic configuration of the present embodiment only will be hereinafter explained. In regard to the configuration of the main rail adjusting mechanism 62, a main rail adjusting mechanism 200, which is different from that of the first embodiment, as hereinafter described may be adopted.

Figure 12:
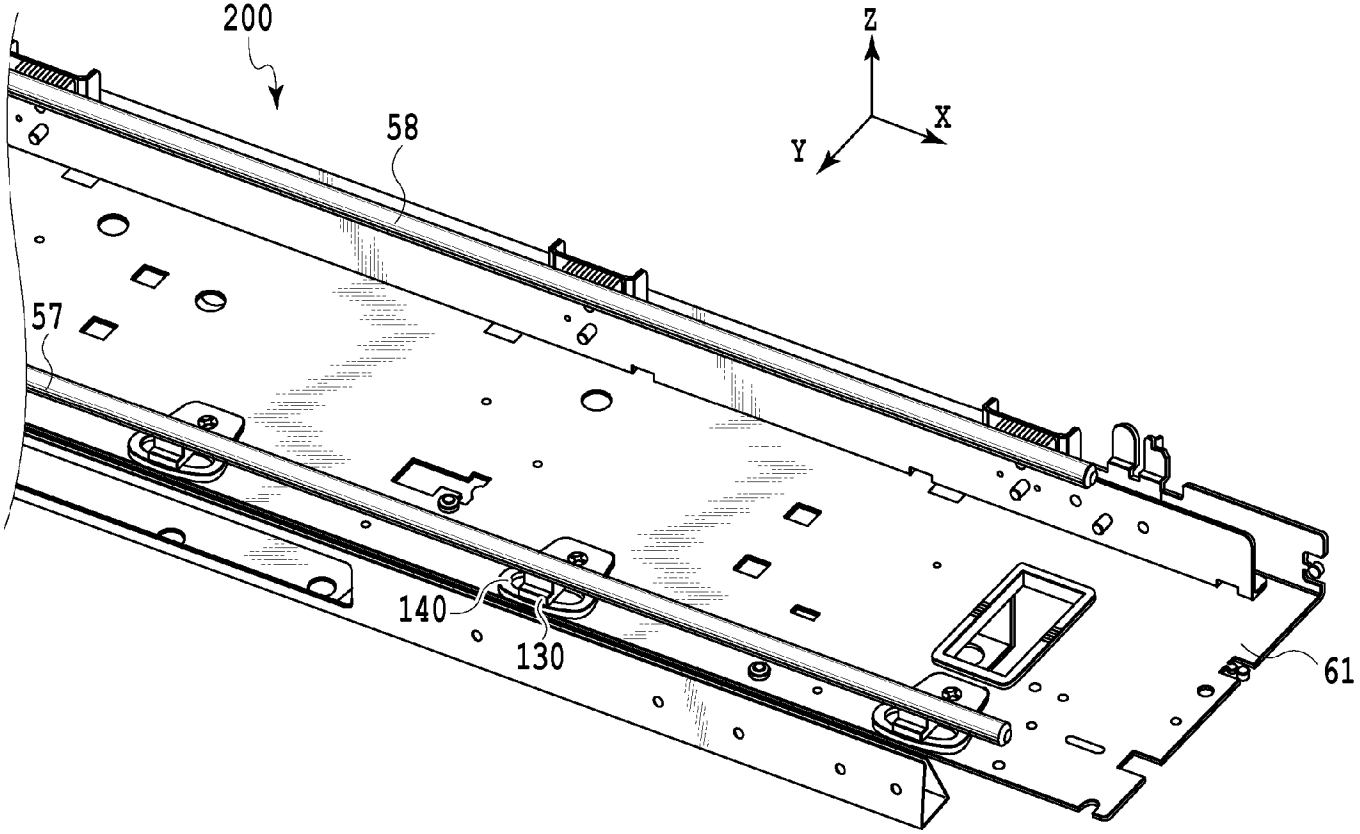
FIG. 12 is a perspective view showing main rail adjusting mechanisms according to a second embodiment.
Figure 13:
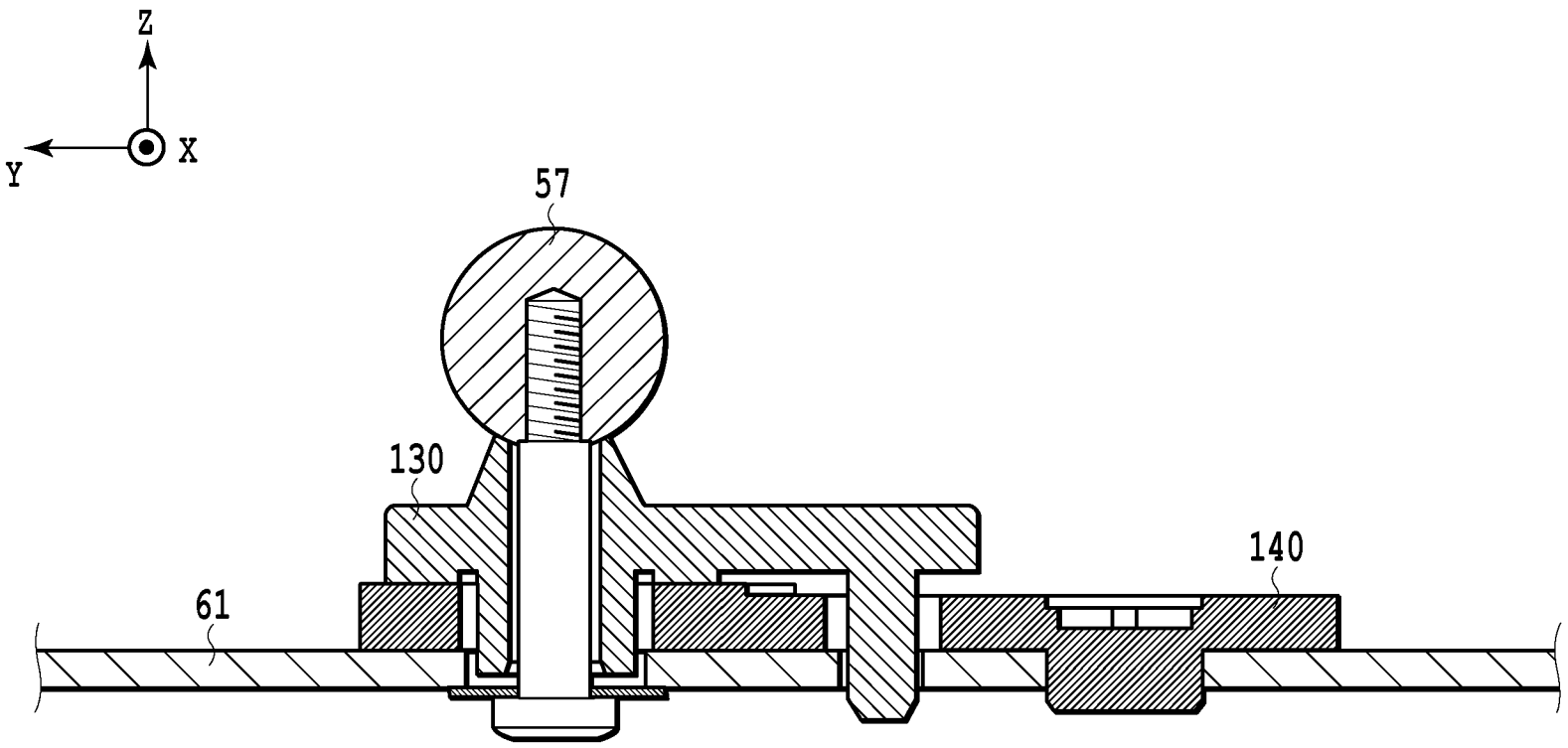
FIG. 13 is a cross-section showing the main rail adjusting mechanism.

FIG. 12 is a perspective view showing the main rail adjusting mechanism 200 in the present embodiment, and FIG. 13 is a cross-section of the main rail adjusting mechanism 200. As shown in FIG. 12 and FIG. 13, the main rail 57, first main rail support members 130 each directly supporting the main rail 57 at its lower portion, and second rail supporting members 140 each supporting the first main rail support member 130 at its lower portion are arranged on the rail support base 61. In the support configuration of the main rail 57, a shape of each configuration member is formed as explained in detail as follows whereby the main rail 57 can be adjusted in position independently in the arrow Y direction and in the arrow Z direction. In addition, the support configurations capable of adjusting the position of the main rail 57 are provided by constant spans in the main scan direction at plural locations, so that the entire main rail 57 is supported to be capable of being adjusted in position.

Figure 15:
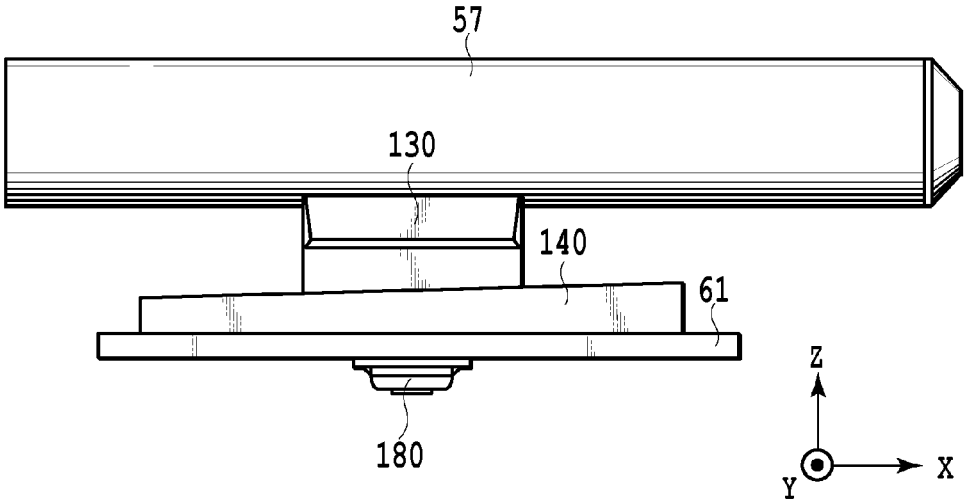
FIG. 15 is a forward front view showing a state of supporting the main rail by the position adjusting unit.
Figure 16A:
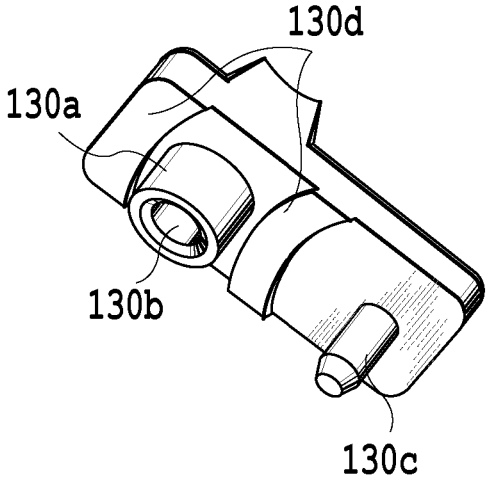
FIG. 16A is a perspective view showing a first main rail support member.
Figure 16B:
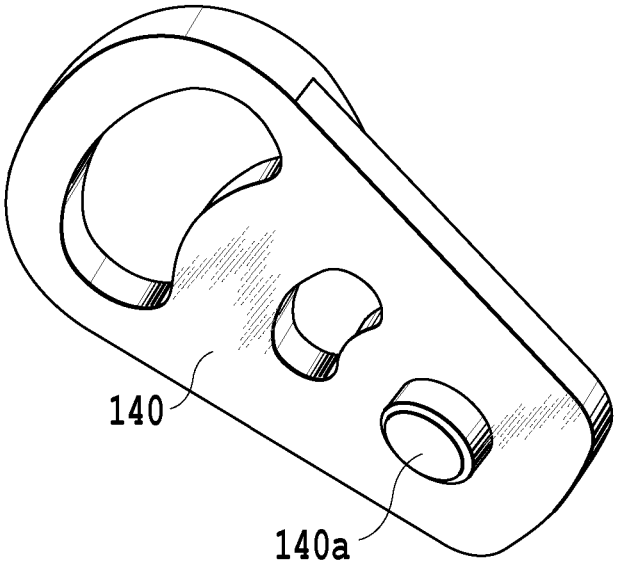
FIG. 16B is a perspective view showing a second main rail support member.

FIG. 14A to FIG. 14D are perspective views as viewed from above, showing a state of supporting the main rail 57 by a position adjusting unit. FIG. 15 is a forward front view showing a state of supporting the main rail 57 by the position adjusting unit. Further, FIG. 16A shows the first main rail support member 130, and FIG. 16B is a perspective view showing the second main rail support member 140 as viewed from below.

Figure 14A:
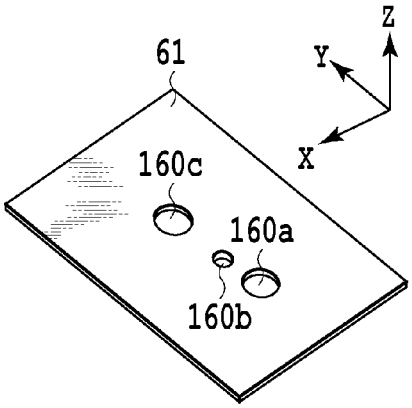
FIG. 14A is a perspective view showing a support base of a main rail position adjusting unit.
Figure 14B:
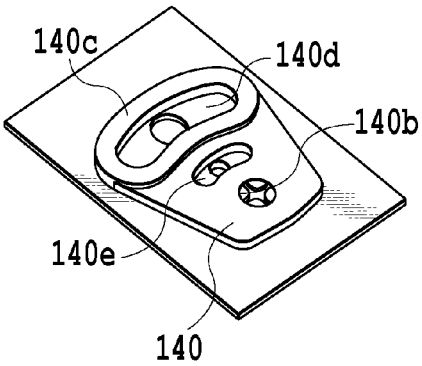
FIG. 14B is a perspective view showing a main rail support member of the position adjusting unit.

As shown in FIG. 14A, the rail support base 61 is provided with a circular hole 160*a*, a long hole 160*b* and a long hole 160*c* formed in a line in the arrow Y direction. The long hole 160*b* and the long hole 160*c* are long holes each having a longer diameter in the arrow Y direction. As shown in FIG. 14B, the second main rail support member 140 is arranged in an upper portion of the rail support base 61. A columnar, convex shape 140*a* as shown in FIG. 16B is formed on a bottom surface of the second main rail support member 140. A concave shape 140*b* engaged to a general tool such as a driver is formed on an opposing surface at the backside to an upper surface of the convex shape 140*a*.

In addition, a surface 140*c* is formed on an upper surface of the second main rail support member 140, and the surface 140*c* is equal in the height of the arrow X direction in regard to a radius direction around the convex shape 140*a* and is inclined in a constant inclination in the circumferential direction. A hole 140*d* is formed in a central portion of the surface 140*c* in the circumferential direction around the convex shape 140*a*, and further, a hole 140*e* is formed likewise in the circumferential direction around the convex shape 140*a* in a position closer to the convex shape 140*a* than the surface 140*c*. Positioning of the second main rail support member 140 to the rail support base 61 is made by engaging the convex shape 140*a* to the circular hole 160*a*.

By using the concave shape 140*b* for rotating the second main rail support member 140 with a driver or the like, the second main rail support member 140 can be slid and rotated on an XY plane to the rail support base 61 on a basis of the circular hole 160*a* as a rotation center. At this time, the long hole 160*c* of the rail support base 61 is always exposed from the hole 140*d* of the main rail support member 140 within the rotation range regularly used, and further, the hole 160*b* of the rail support base 61 is always exposed from the hole 140*e* of the main rail support member 140.

Figure 14C:
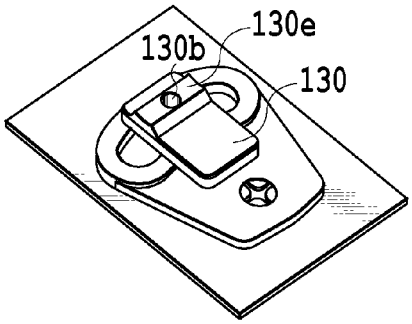
FIG. 14C is a perspective view showing main rail support members of the position adjusting unit.

As shown in FIG. 14C, the first main rail support member 130 is arranged on an upper portion of the second main rail support member 140. An arc, concave shape 130*e* supporting the main rail 57 is formed on an upper surface of the first main rail support member 130. A cylindrical, convex shape 130*a* and a columnar, convex shape 130*c* as shown in FIG. 16A are formed on a bottom surface of the first main rail support member 130. A hollow portion 130*b* of the convex shape 130*a* penetrates from a tip end of the convex shape 130*a* to the upper surface of the first main rail support member 130, and the hollow portion 130*b* is positioned in a central portion of the concave shape 130*e* on the upper surface.

Figure 14D:
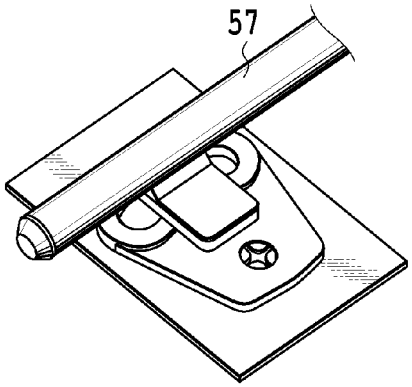
FIG. 14D is a perspective view showing the main rail supported by the position adjusting unit.

In addition, surfaces 130*d* are formed on the bottom surface of the first main rail support member 130, and the surface 130*d* is equal in the height of the arrow Z direction in regard to a radius direction around the circular hole 160*a* of the rail support base 61, and is an inclination surface inclined in a constant inclination in the circumferential direction. The inclination is equal to that of the surface 140*c* as a contact surface of the second main rail support member 140. As a result, in a state where the first main rail support member 130 is arranged on the upper portion of the second main rail support member 140, the surface 140*c* and the surface 130*d* make contact with each other without any clearance to cancel out the inclination. As a result, as shown in FIG. 14D, at the time of receiving the main rail 57 in the concave shape 130*e*, the main rail 57 becomes in parallel with the rail support base 61 any time. That is, the contact surface between the first main rail support member 130 and the second main rail support member 140 forms a surface inclined in an axial direction of the main rail 57 supported by the first main rail support member 130.

A position of the first main rail support member 130 to the rail support base 61 in the arrow X direction is regulated in the arrow X direction by a shorter diameter width of the long hole 160*c* of the rail support base 61 with the convex shape 130*a* passing through the hole 140*d* of the second main rail support member 140. Further, a position of the first main rail support member 130 to the rail support base 61 in the arrow X direction is regulated in the arrow X direction by a shorter diameter width of the long hole 160*b* of the rail support base 61 with the convex shape 130*c* passing through the hole 140*e* of the second main rail support member 140.

Here, as the second main rail 140 is rotated around the circular hole 160*a* of the rail support base 61, a frictional force in the arrow X direction acts on the first main rail support member 130 from the second main rail support member 140. However, the movement of the first main rail support member 130 is regulated in the arrow X direction to the rail support base 61. Therefore the surface 140*c* of the second main rail support member 140 slides (relatively moves) to the surface 130*d* of the first main rail support member 130 to change the position of each of the first main rail support member 130 and the main rail 57 in the arrow Z direction, thus adjusting the position of the main rail 57. At this time, the main rail 57 is changed in position in a state of maintaining the main rail 57 to be in parallel with the rail support base 61.

In addition, the convex shape 130*a* and the convex shape 130*c* of the first main rail supporting member 130 respectively have a clearance in the arrow Y direction to the long hole 160*c* and the long hole 160*b* of the rail support base 61. Further, the convex shape 130*a* and the convex shape 130*c* of the first main rail supporting member 130 respectively have a clearance in the arrow Y direction also to the hole 140*d* and the hole 140*e* of the main rail support member 140. Therefore the first main rail support member 130 is movable in the arrow Y direction to the rail support base 61 and the second main rail support member 140.

Both of the surface 130*d* of the first main rail support member 130 and the surface 140*c* of the second main rail support member 140 have the same inclination in the circumferential direction around the circular hole 160*a* of the rail support base 61. Therefore the first main rail support member 130 and the main rail 57 can move (can be adjusted) in the arrow Y direction while maintaining the positions of the first main rail support member 130 and the main rail 57 in the arrow Z direction. The positioning of the main rail 57 in the arrow Y direction may be made by being adjusted with accuracy to the rail support base 61 by using, for example, a positioning tool or the like.

With the above configuration, the main rail 57 can be adjusted in the arrow Z direction and in the arrow Y direction independently for positioning. The main rail 57 is adjusted in position in the desired arrow Z direction and in the desired arrow Y direction, and the main rail 57 is fastened to the rail support base 61 by a main rail fastening bolt 180 from the lower side. Thereby the first main rail support member 130 and the second main rail support member 140 are fixed in the form of being sandwiched between the rail support base 61 and the main rail 57.

The main rail 57 is adjusted in such a method, and the HP distance and the sub rail 58 are adjusted by the method of the first embodiment. Thereby the curve amount of both the rails is made to be in agreement with the curve amount of the platen 21 to perform the adjustment for minimizing the local deformation of both the rails.

Thereby there can be realized the wide-format inkjet printing apparatus which can suppress a posture variation of the carriage to improve landing-on accuracy of ink, and can reduce the HP distance to the minimum narrowness, thus achieving higher image quality and mass-production performance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-103808, filed Apr. 27, 2012, which is hereby incorporated by reference herein in its entirety.

What is claimed is:

1. A printing apparatus comprising:

a carriage configured to mount a print head and to move in a first direction;

a main rail for guiding the carriage in the first direction;

a sub rail for guiding the carriage in the first direction;

a rail support base for supporting the main rail and the sub rail;

a platen for supporting a print medium conveyed in a second direction which crosses the first direction;

a rail support base adjusting unit for adjusting the rail support base in a third direction which crosses the first direction and the second direction when the carriage is mounted on the main rail and the sub rail;

a main rail adjusting unit for adjusting the position of the main rail at plural locations in the first direction; and a sub rail adjusting unit for adjusting the position of the sub rail at plural locations in the first direction.

2. A printing apparatus according to claim 1, wherein for the adjustment by the main rail adjusting unit and the adjustment by the sub rail adjusting unit, the carriage is arranged in a central part of a print region printable by the print head in the first direction.

3. A printing apparatus according to claim 1, wherein the rail support base adjusting unit is provided at both end portions and in a central portion of the main rail in the first direction.

4. A printing apparatus according to claim 3, wherein the adjusting units provided at both the end portions and in the central portion of the main rail in the first direction are provided at positions at both end portions of the carriage in the first direction at the time the carriage is arranged at a central part of a print region printable by the print head.

5. A printing apparatus according to claim 1, wherein the rail support base adjusting unit adjusts the positions of the main rail and the sub rail in the third direction relative to the platen by adjusting a position of the rail support base.

6. A printing apparatus according to claim 1, wherein the rail support base adjusting unit is capable of adjusting a curve amount of the main rail in a direction of a center of gravity and a curve amount of the sub rail in a direction of a center of gravity to correspond to a curve amount of the platen in a direction of the center of gravity.

7. A printing apparatus according to claim 1, wherein the main rail adjusting unit includes a first main rail support member directly supporting the main rail, and a second main rail support member directly supporting the first main rail support member, and wherein each contact surface between the first main rail support member and the second main rail support member includes an inclination surface inclined in an axial direction of the supported main rail.

8. A printing apparatus according to claim 7, wherein the main rail adjusting unit is configured so that the second main rail support member moves relatively to the first main rail support member, and thereby the inclination surface of the second main rail support member slides to the inclination surface of the first main rail support member to change a height of the first main rail support member.

9. A printing apparatus according to claim 8, wherein the first main rail support member is movable in the second direction to the second main rail support member, and the inclination surface is equal in height in the second direction.

10. A printing apparatus according to claim 8, wherein the relative movement of the second main rail support member to the first main rail support member includes a movement by rotation of the second main rail support member.

11. An adjusting method comprising:

a movement step wherein a carriage equipped with a print head moves in a first direction;

a guiding step wherein a main rail and a sub rail guide the carriage in the first direction;

a supporting step wherein a rail support base supports the main rail and the sub rail;

a rail support base adjusting step wherein a support base adjusting unit adjusts the rail support base in a third direction which crosses the first direction and a second, printing medium conveyance direction when the carriage is mounted on the main rail and the sub rail;

a main rail adjusting step wherein a main rail adjusting unit adjusts the position of the main rail at plural locations in the first direction; and a sub rail adjusting step wherein a sub rail adjusting unit adjusts the position of the sub rail at plural locations in the first direction, wherein the main rail adjusting step and the sub rail adjusting step are performed after the rail support base adjusting step is performed.

* * * * *